US005804798A

United States Patent [19]

Takeda

[11] Patent Number: 5,804,798

[45] Date of Patent: Sep. 8, 1998

[54] THERMAL PROTECTOR WITH BIMETAL PLATE

[75] Inventor: Hideaki Takeda, Misato, Japan

[73] Assignee: Uchiya Thermostat Co., Ltd., Mitsato, Japan

[21] Appl. No.: 790,889

[22] Filed: Jan. 29, 1997

[30] Foreign Application Priority Data

Jan. 29, 1996 [JP] Japan ..... 8-012693

[51] Int. Cl.[6] ..... H05B 1/02

[52] U.S. Cl. ..... 219/511; 219/512; 219/494; 219/549; 337/102; 337/107

[58] Field of Search ..... 219/511, 512, 219/508, 494, 549; 337/102–107

[56] References Cited

U.S. PATENT DOCUMENTS

| | | | |
|---|---|---|---|
| Re. 31,596 | 6/1984 | Kicherer et al. | 219/507 |
| 4,174,511 | 11/1979 | Knapp et al. | 337/10.7 |
| 4,394,649 | 7/1983 | Gossler | 340/594 |
| 4,704,595 | 11/1987 | Essig et al. | 337/107 |
| 5,233,325 | 8/1993 | Takeda . | |
| 5,607,610 | 3/1997 | Furukawa | 219/505 |

FOREIGN PATENT DOCUMENTS 1246737 10/1989 Japan .

OTHER PUBLICATIONS

Japanese Unexamined Patent Application No. 3–72940.
No. 1 –catalog of Polyimide film of Toray–Dupon.
No. 2 –catalog of Polyimide film of Toray–Dupon.

*Primary Examiner*—Mark H. Paschall

[57] ABSTRACT

A thermal protector having a fixed plate with a fixed contact point at one end, a movable plate having a movable contact point at a position corresponding to the fixed contact point. A bimetal plate which bends when a temperature exceeds a specified level deforms movable plate so as separate the contacts. There are first and second terminals connecting the fixed and movable plates with an external circuit and a heating element connected to the first and second terminals to maintain an open-circuited state. The heating element is flexible and is arranged so as to be deformed following the deformation of the bimetal plate and to always physically contact always with the bimetal plate.

7 Claims, 3 Drawing Sheets

THERMAL PROTECTOR WITH BIMETAL PLATE

FIELD OF THE INVENTION AND RELATED ART

The present invention relates to a thermal protector, comprising a fixed plate having a fixed contact point on its one end, a movable plate having a movable contact point at a position corresponding to the fixed contact point, a bimetal plate which bends when a temperature exceeds a specified level and deforms the movable plate so as to move the movable contact point away from the fixed contact point, first and second terminals for connecting the fixed and movable plates to external circuits and a heating element connected to the first and second terminals.

For a thermal protector, so called an inversion type bimetal plate is used as a bimetal plate, which changes its bending direction at a specified temperature.

When a temperature exceeds the specified level, the inversion type bimetal plate inverts its bending direction. By the inversion, a movable plate arranged adjacently to the bimetal plate is pushed to be deformed, which causes movable contact point to separate from fixed contact point. This makes it possible to cut off the power supply, etc.

After cutting off of the power supply, etc., the temperature of the bimetal plate declines, which causes the movable contact point to contact with the fixed contact point again; this means that the circuit closes again. Thus it is necessary to prevent this and to maintain the cut-off state.

For this purpose, it is known to connect a heating element, in parallel with the switch circuit, which is composed of a fixed plate, a fixed contact point, a movable contact point and a movable plate.

In Japanese Unexamined Patent Application Publication No. 3-72940, a thermostat is disclosed, which uses a film-like heating element as a heating element.

FIG. 10 is a cross-section view of a thermostat disclosed in the Publication. A heating element 1 is arranged below a fixed plate 4. When a switch circuit is closed, a current hardly flows though the heating element. However, once the switch circuit is opened, a current flows to resistor, which generates heat. Thus the temperature of a bimetal plate is maintained high and the switch is kept in its open state.

A miniaturization of a thermal protector is greatly required. On the other hand, the operation of a thermal protector must be assured even at a lower temperature range (e.g. at a room temperature). For such a purpose, it is necessary to generate heat, sufficiently to heat the bimetal plate to its specific temperature (e.g. 120° C.).

However, such thermal protector having a sufficient heat generating capacity is used in a small space, at a relatively high environmental temperature, it tends to generate a heat excessively.

OBJECTS AND SUMMARY OF THE INVENTION

An object of the present invention is to provide a thermal protector, which can prevent an internal excess heat generation, another object of the present invention is to improve a heat contact between a heating element and a bimetal plate, for effective heating of the bimetal plate, using small amount of heat, to maintain the inverted state of the bimetal plate.

The aforementioned object is achieved by using a flexible heating element, and arranging the same to contact always with the bimetal plate, so as to be deformed following the bending of the bimetal plate.

In a preferred embodiment of the present invention, the heating element is composed of a flexible film-like resistor and a flexible insulating film, which covers the resistor on both surfaces.

In another preferred embodiment of the invention, at least one surface of the heating element is covered by a metal foil in order that the temperature of the heating element becomes uniform.

Because heating element is flexible, it can be deformed following the shape change of the bimetal plate, at the inversion of the bimetal plate. As a result, the contact between the heating element and the bimetal plate can be maintained.

The effects of the present invention are summarized as follows.

(1) The heat generation is reduced compared with the thermal protector of the prior art. In a prior art, there are cases that no contact is made between the heating element and the bimetal plate at a higher temperature or at a lower temperature.

(2) Although the bimetal plate contacts with the heating element, the inverting action of the bimetal plate is not hampered, because of the flexibility of the heating element. Since heat generation is sufficient, an excessive heating in the internal part of the thermal protector hardly occurs.

EMBODIMENTS

Figure 1:
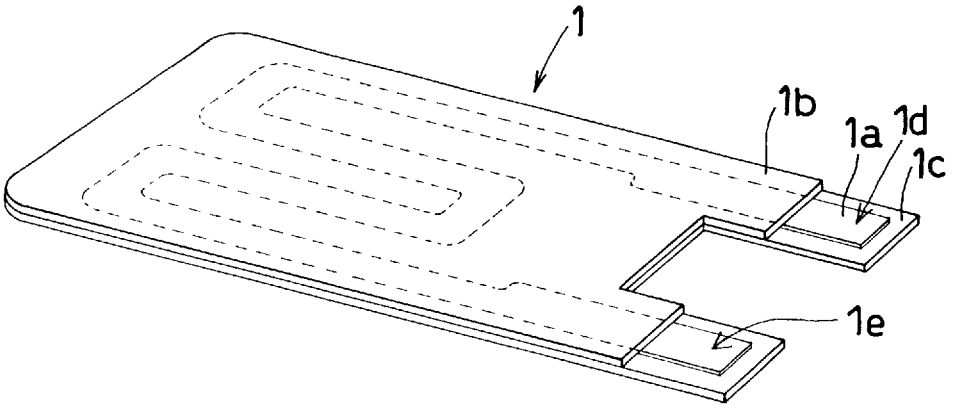
FIG. 1 is a perspective view of an example of a heating element used in a thermal protector of the present invention.

FIG. 1 illustrates in perspective am example of a heating element 1 used in a thermal protector of the present invention.

The heating element comprises a temperature resistive and electrically conductive synthetic resin film 1*a* and a temperature resistive and electrically insulative synthetic resin film 1*b* covering said electrically conductive synthetic resin film 1*a*; both the synthetic resin films 1*a* and 1*b* are, for example, polyimide synthetic resins of different types, which are commercially available as a synthetic resin film named "Kapton"; the electrically conductive synthetic resin film 1*b* is cut into a meander to form a electric resistor. It is also possible to cover only one surface of said electrically conductive synthetic resin film. Only electrode portions 1*d* and 1*e* at both ends of the conductive synthetic resin film 1*a* are not covered and are exposed. The thickness of each film is about several tens micro-meters.

Figure 2:
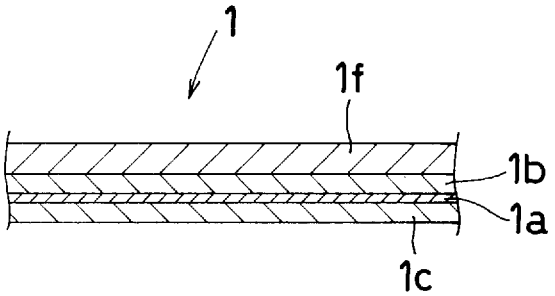
FIG. 2 is a cross-section view of an example of the heating element of FIG. 1, one side of which is covered by a metal foil to make its temperature to be uniform.

FIG. 2 shows a cross-section of an example of the heating element of FIG. 1, one side face of which is covered by a metal foil 1*f* in order that the temperature of the heating element becomes uniform.

Figure 3:
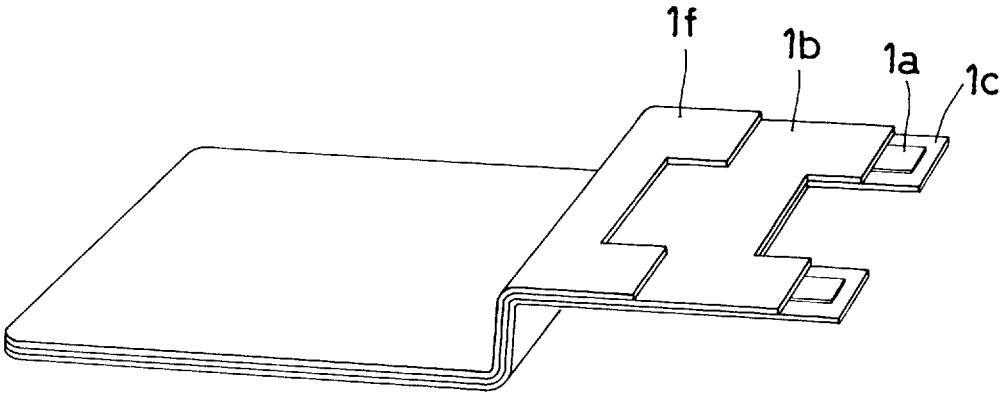
FIG. 3 is a perspective view of the heating element of FIG. 2.

FIG. 3 shows a perspective view of the heating element of FIG. 2.

Figure 4:
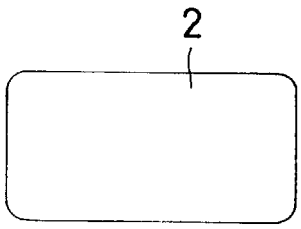
FIG. 4 is a plan view of an example of a bimetal plate.
Figure 5:
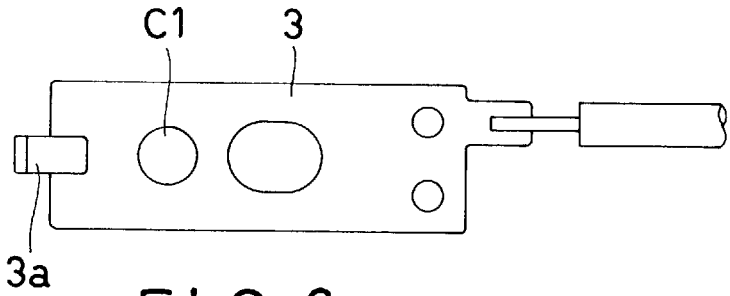
FIG. 5 is a plan view of an example of a movable plate.
Figure 6:
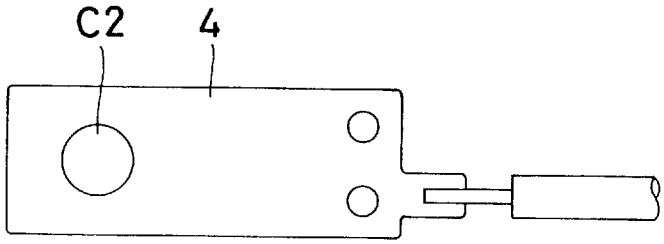
FIG. 6 is a plan view of an example of a fixed plate.

FIGS. 4, 5 and 6 respectively show plans of a bimetal plate 2, a movable plate 3 and a fixed plate 4 of an example of a thermal protector.

First and second terminals are provided at the ends of the fixed and movable plates 4 and 3. These terminals serve to connect the plates with an external circuit.

Movable and fixed contact points C1 and C2 are respectively provided at the vicinities of the other ends of the movable and fixed plates 3 and 4.

A catch 3*a* for loosely locking the bimetal plate 2 is provided at the other end of the movable plate 3.

Preferably, the heating element is previously formed to fit the shapes of the bimetal plate and another neighbouring elements.

Figure 7:
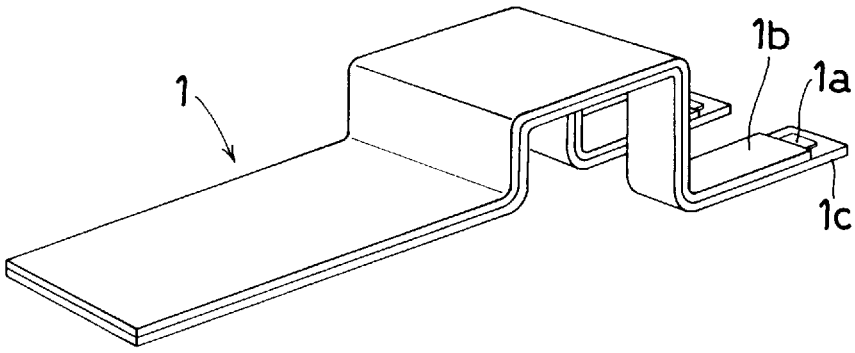
FIG. 7 is a perspective view of a modified example of the heating element of FIG. 1.

FIG. 7 shows a perspective view of the heating element 1 of FIG. 1, in which the electrode portions are bent so as to be connected with the terminals T1 and T2 (not shown in FIG. 7).

Figure 8:
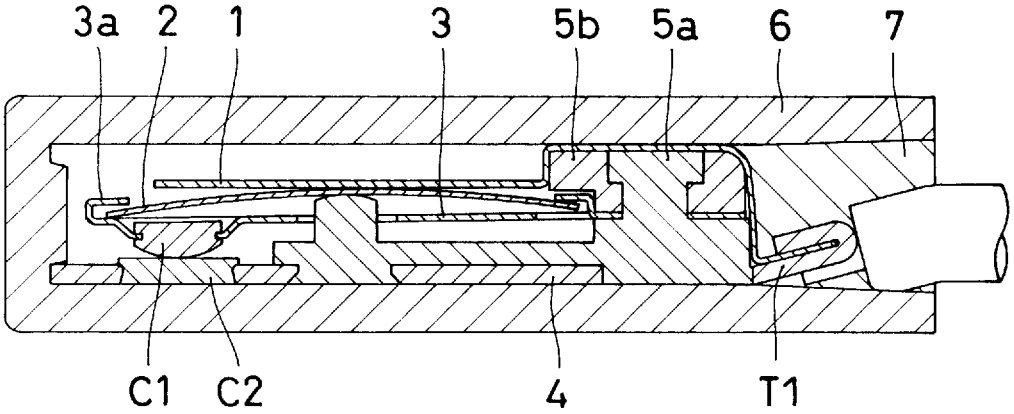
FIG. 8 is a cross-section view of a thermal protector equipped with the bimetal plate, the movable plate, the fixed plate and the heating element of FIGS. 4, 5, 6 and 7 at a low temperature.

FIG. 8 shows a cross-section of a thermal protector of FIGS. 4, 5, 6 and 7, which is equipped with the bimetal plate 2, the movable plate 3, the fixed plate 4 and the heating element 1, at a lower temperature than the specified level. The fixed plate 4 and the movable plate 3 are fixed to each other by an insulating support 5*a*. One end of the bimetal plate 2 is loosely fixed in the recessed part of the catch 3*a* of the movable plate 3 and the other end is loosely fixed in a recessed part between the insulating support 5*a* and an insulting fixing member 5*b*. An assembly including the bimetal plate 2, the movable plate 3 and the fixed plate 4 is inserted into a housing 6 and sealed by a resin 7.

Materials used for the insulting support 5*a*, the insulting fixing member 5*b* and the housing 6 are, for instance PPS (polyphenylene sulfide resin).

A current flows in the thermal protector through a path: the second terminal T2 (not shown in FIG. 8), the movable plate 3, the movable contact point C1, the fixed contact point C2, the fixed plate 4 and the first terminal T1 in this order or in the reversed direction. Both electrodes 1*d* and 1*e* of the heating element 1 are respectively connected to the first and second terminals T1 and T2. At a lower temperature, however, only a small current flows through the heating element.

Since the bimetal plate is loosely held, when a temperature exceed its specified level, the bimetal plate changes its form, so as that the sign of the curvature of the bimetal plate 2 is inverted.

As a result, the movable plate 3 is pushed up by the bimetal plate 2 and the movable contact point C1 is moved away from the fixed contact point C2. This results in the opening of the circuit. And a current flows through the heating element 1 to generate heat.

Figure 9:
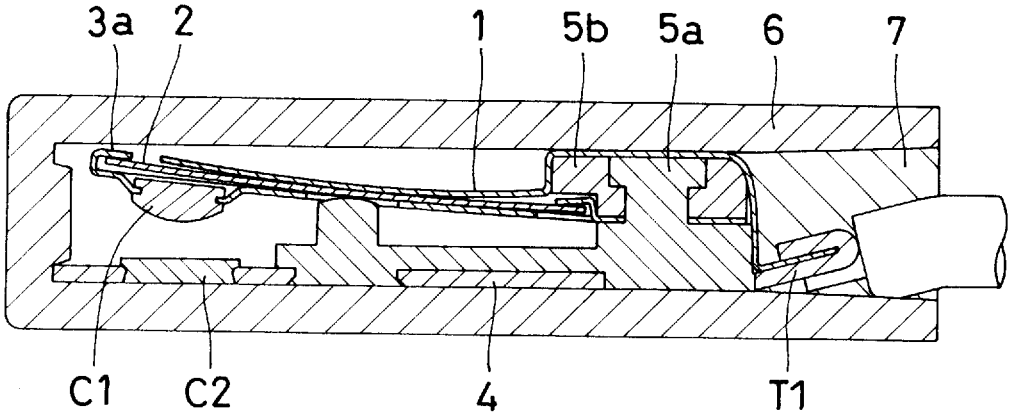
FIG. 9 is a cross-section view of the thermal protector of FIG. 8 at a high temperature.
Figure 10:
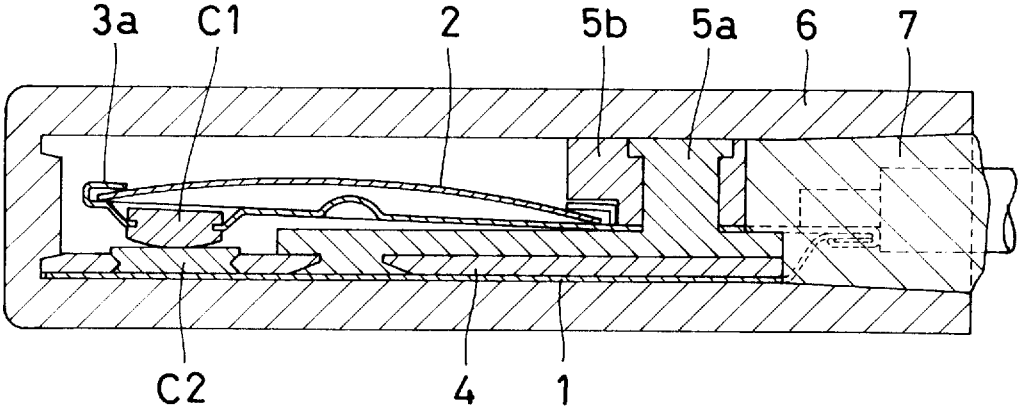
FIG. 10 (PRIOR ART)
FIG. 10 is a cross-section view of a thermal protector of a prior art.

FIG. 9 shows the thermal protector of FIG. 8 at a higher temperature than the specified level. Since the heating element 1 is flexible as shows in FIG. 1, the heating element 1 is following the deformed shape of the bimetal plate 2 as shows in FIG. 9.

As described above, the heating element 1 always contacts with the bimetal plate 2. Therefore, efficiency of heat transmission from the heating element 1 to the bimetal plate 2 is improved, which makes it possible to effectively maintain the inverted state of the bimetal plate using a small heat generation.

What is claimed is:

1. A thermal protector comprising:

a fixed plate having a fixed contact point at one end;

a movable plate having a movable contact point at a position corresponding to the fixed contact point;

a bimetal plate which bends when a temperature exceeds a specified level and deforms said movable plate so as to move said movable contact point to disconnect away from said fixed contact point;

first and second terminals for connecting said fixed and movable plates with an external circuit; and a heating element connected to said first and second terminals, wherein said heating element is flexible and substantially flat and is arranged so as to follow the bending of the bimetal plate and to always physically contact a single surface of the bimetal plate.

2. A thermal protector as claimed in claim 1, in which said heating element is comprised of a film electric resistor, and a film electric insulator, covering at least one surface of said film electric resistor.

3. A thermal protector as claimed in claim 2, in which said film electric insulator is covered by a metal foil.

4. A thermal protector as claimed in claim 1, in which said heating element is preformed so as to fit the shapes of the bimetal plate and parts adjacent to the bimetal plate.

5. A thermal protector as claimed in claim 1, wherein said single surface is a top surface of the bimetal plate.

6. A thermal protector as claimed in claim 2, wherein there are two film electric insulators, each one covering a surface of said film resistor.

7. A thermal protector as claimed in claim 6, a metal foil covers a surface of one of the film electric insulators so that the temperature of the heating element is uniform.

* * * * *

UNITED STATES PATENT AND TRADEMARK OFFICE

CERTIFICATE OF CORRECTION

PATENT NO. : 5,804,798
DATED : September 8, 1998
INVENTOR(S) : Hideaki Takeda

It is certified that error appears in the above-identified patent and that said Letters Patent is hereby corrected as shown below:

The Title page should be deleted and substitute therefor the attached Title page.

Drawings:

Delete FIGS. 1-3 and 8-10 and substitute therefor FIGS. 1-3 and 8-10 as shown on the attached pages.

Signed and Sealed this

Twenty-sixth Day of September, 2000

*Attest:*

Q. TODD DICKINSON

*Attesting Officer*

*Director of Patents and Trademarks*

United States Patent [19]

Takeda

[11] Patent Number: 5,804,798

[45] Date of Patent: Sep. 8, 1998

[54] THERMAL PROTECTOR WITH BIMETAL PLATE

[75] Inventor: Hideaki Takeda, Misato, Japan

[73] Assignee: Uchiya Thermostat Co., Ltd., Mitsato, Japan

[21] Appl. No.: 790,889

[22] Filed: Jan. 29, 1997

[30] Foreign Application Priority Data

Jan. 29, 1996 [JP] Japan ..... 8-012693

[51] Int. Cl.[6] ..... H05B 1/02

[52] U.S. Cl. ..... 219/511; 219/512; 219/494; 219/549; 337/102; 337/107

[58] Field of Search ..... 219/511, 512, 219/508, 494, 549; 337/102–107

[56] References Cited

U.S. PATENT DOCUMENTS

| | | | |
|---|---|---|---|
| Re. 31,596 | 6/1984 | Kicherer et al. | 219/507 |
| 4,174,511 | 11/1979 | Knapp et al. | 337/10.7 |
| 4,394,649 | 7/1983 | Gossler | 340/594 |
| 4,704,595 | 11/1987 | Essig et al. | 337/107 |
| 5,233,325 | 8/1993 | Takeda . | |
| 5,607,610 | 3/1997 | Furukawa | 219/505 |

FOREIGN PATENT DOCUMENTS 1246737 10/1989 Japan .

OTHER PUBLICATIONS

Japanese Unexamined Patent Application No. 3-72940.
No. 1 –catalog of Polyimide film of Toray–Dupon.
No. 2 –catalog of Polyimide film of Toray–Dupon.

*Primary Examiner*—Mark H. Paschall

[57] ABSTRACT

A thermal protector having a fixed plate with a fixed contact point at one end, a movable plate having a movable contact point at a position corresponding to the fixed contact point. A bimetal plate which bends when a temperature exceeds a specified level deforms movable plate so as separate the contacts. There are first and second terminals connecting the fixed and movable plates with an external circuit and a heating element connected to the first and second terminals to maintain an open-circuited state. The heating element is flexible and is arranged so as to be deformed following the deformation of the bimetal plate and to always physically contact always with the bimetal plate.

7 Claims, 3 Drawing Sheets

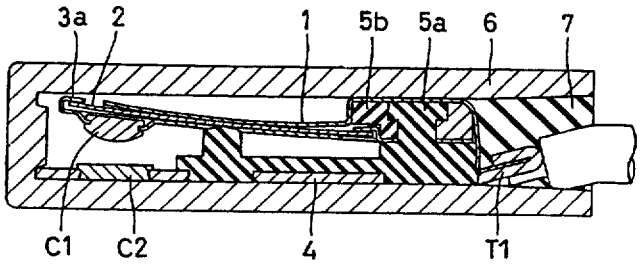

UNITED STATES PATENT AND TRADEMARK OFFICE

CERTIFICATE OF CORRECTION

PATENT NO. : 5,804,798

DATED : September 8, 1998

INVENTOR(S) : Hideaki TAKEDA

It is certified that error appears in the above-identified patent and that said Letters Patent is hereby corrected as shown below:

FIG.1

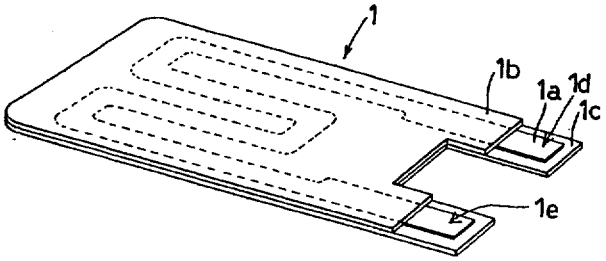

FIG.2

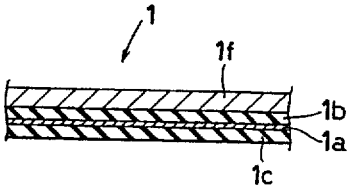

FIG.3

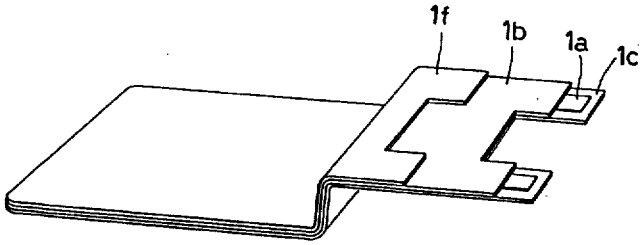

UNITED STATES PATENT AND TRADEMARK OFFICE

CERTIFICATE OF CORRECTION

PATENT NO. : 5,804,798

DATED : September 8, 1998

INVENTOR(S) : Hideaki TAKEDA

It is certified that error appears in the above-identified patent and that said Letters Patent is hereby corrected as shown below:

FIG. 8

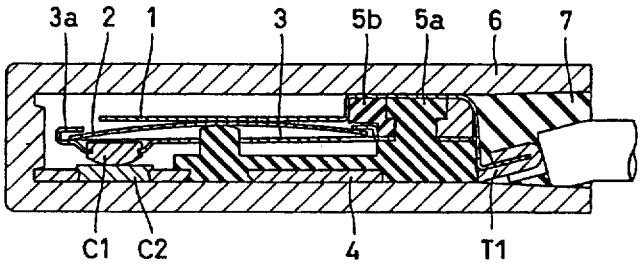

FIG. 9

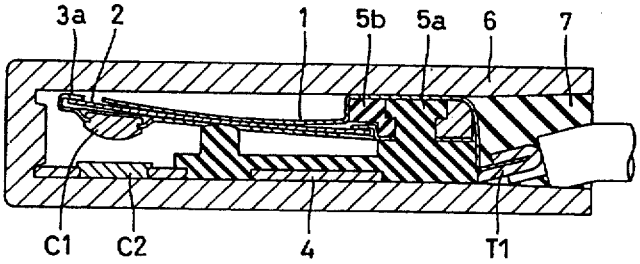

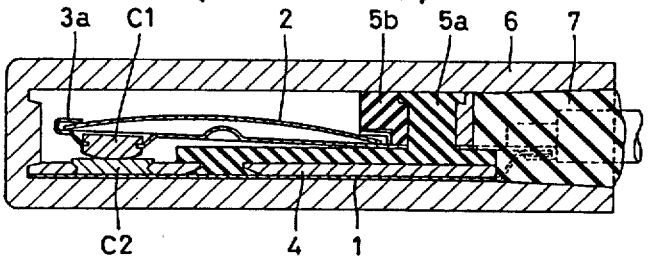

FIG. 10
(PRIOR ART)